US008213847B2

(12) United States Patent
Murakami et al.

(10) Patent No.: US 8,213,847 B2
(45) Date of Patent: Jul. 3, 2012

(54) IMAGE FORMING APPARATUS INCLUDING TRANSPORT UNIT

(75) Inventors: Junichi Murakami, Kanagawa (JP); Atsuyuki Kitamura, Kanagawa (JP); Masahiro Sato, Kanagawa (JP); Satoru Torimaru, Kagoshima (JP); Atsushi Ogihara, Kanagawa (JP); Tetsuji Okamoto, Kanagawa (JP); Shuichi Nishide, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 394 days.

(21) Appl. No.: 12/538,988

(22) Filed: Aug. 11, 2009

(65) Prior Publication Data

US 2010/0247177 A1 Sep. 30, 2010

(30) Foreign Application Priority Data

Mar. 24, 2009 (JP) ..... 2009-071239

(51) Int. Cl.
*G03G 15/16* (2006.01)

(52) U.S. Cl. ..... 399/316; 399/388

(58) Field of Classification Search ..... 399/316, 399/388; 271/248, 251
See application file for complete search history.

(56) References Cited

U.S. PATENT DOCUMENTS

| | | | | |
|---|---|---|---|---|
| 4,426,073 | A * | 1/1984 | Mizuma | 271/251 |
| 5,284,333 | A * | 2/1994 | Ishikawa | 271/22 |
| 5,316,288 | A * | 5/1994 | Fish et al. | 271/250 |
| 5,406,360 | A * | 4/1995 | Asai | 399/313 |
| 5,507,482 | A * | 4/1996 | Tenpaku et al. | 271/251 |
| 5,651,539 | A | 7/1997 | Yoshiuchi et al. | |
| 5,657,983 | A * | 8/1997 | Fisk | 271/251 |
| 5,828,939 | A | 10/1998 | Yoshiuchi et al. | |
| 5,967,511 | A * | 10/1999 | Bell | 271/252 |
| 6,273,418 | B1 * | 8/2001 | Fujikura et al. | 271/228 |
| 6,324,377 | B2 * | 11/2001 | Ando et al. | 399/395 |
| 7,445,208 | B2 * | 11/2008 | Onodera | 271/239 |
| 7,658,379 | B2 * | 2/2010 | Yasumoto | 271/251 |
| 2004/0175213 | A1 * | 9/2004 | Matsuzuki et al. | 399/384 |

(Continued)

FOREIGN PATENT DOCUMENTS

JP 08-188301 7/1996

(Continued)

OTHER PUBLICATIONS

Machine Translation ofJP-10-239945.*

*Primary Examiner* — David Gray
*Assistant Examiner* — G. M. Hyder
(74) *Attorney, Agent, or Firm* — Fildes & Outland, P.C.

(57) ABSTRACT

An image forming apparatus includes: an image carrier; a development unit that develops an electrostatic latent image present on the image carrier with a developer; a transfer member that transfers a developer image developed by the development unit from the image carrier to a recording medium by transporting while nipping the recording medium in a transfer position in contact with the image carrier; a corrective guide member that contacts the recording medium which is simultaneously caught by the transfer member for a period and that corrects placement of the recording medium with respect to the transfer member, thus guiding the recording medium toward the transport position; and a transport unit that transports the recording medium toward the transfer position while exerting a force on the recording medium in a direction causing a side edge of the recording medium along a transport direction to abut the corrective guide member.

5 Claims, 9 Drawing Sheets

U.S. PATENT DOCUMENTS

2004/0188929 A1* 9/2004 Tada et al. ..... 271/248
2007/0273092 A1* 11/2007 Inui ..... 271/251
2008/0230975 A1* 9/2008 Matsuzuki et al. ..... 270/52.08
2008/0230986 A1* 9/2008 Tada et al. ..... 271/248
2009/0267292 A1* 10/2009 Inui et al. ..... 271/229
2009/0295077 A1* 12/2009 Murakami et al. ..... 271/229
2010/0327519 A1* 12/2010 Miyazawa ..... 271/248

FOREIGN PATENT DOCUMENTS

JP 10-239945 9/1998

* cited by examiner $Ft2 < Fg3$ $Ft2 = K \times L < Fg3$

CASE WHERE TRANSFER ROLLER SLANTS

CASE WHERE THERE ARE DIFFERENT CONTACT PRESSURES (NIP PRESSURES) IN BOTH ENDS OF TRANSFER ROLLER

CASE WHERE RECORDING MEDIUM SAGS BETWEEN TRANSFER ROLLER AND SKEW ROLLER

IMAGE FORMING APPARATUS INCLUDING TRANSPORT UNIT

CROSS-REFERENCE TO RELATED APPLICATIONS

This application is based on and claims priority under 35 USC 119 from Japanese Patent Application No. 2009-071239 filed Mar. 24, 2009.

BACKGROUND

Technical Field

The present invention relates to an image forming apparatus.

SUMMARY

According to an aspect of the present invention, there is provided an image forming apparatus including an image carrier; a development unit that develops an electrostatic latent image present on the image carrier with a developer; a transfer member that transfers a developer image developed by the development unit from the image carrier to a recording medium by transporting while nipping the recording medium in a transfer position in contact with the image carrier; a corrective guide member that contacts the recording medium which is simultaneously caught by the transfer member for a period and that corrects placement of the recording medium with respect to the transfer member, thus guiding the recording medium toward the transport position; and a transport unit that transports the recording medium toward the transfer position while exerting a force on the recording medium in a direction causing a side edge of the recording medium along a transport direction to abut the corrective guide member, so that a force exerted on the recording medium in the transfer position in a direction orthogonal to a guide direction in which the corrective guide member guides the recording medium is larger than a force component in a direction orthogonal to the guide direction of a force by which the image carrier and the transfer member transport the recording medium in the transfer position.

BRIEF DESCRIPTION OF THE DRAWINGS

An exemplary embodiment of the present invention will be described in detail based on the following figures, wherein:

FIGS. 2A and 2B schematically illustrate transporting a recording medium with skew rollers, a transfer roller, and an image carrier and its result, wherein FIG. 2A shows a view of the direction in which a recording medium is transported for transfer and FIG. 2B shows a combined image resulting from developer images in plural colors formed as the result of the transport;

FIGS. 6A to 6D schematically illustrate a comparison example as compared to the present invention, wherein FIGS. 6A to 6C show how a recording medium is directed, when transported by the transfer roller and the image carrier with the aid of the skew rollers and FIG. 6D shows a combined image resulting from developer images in different colors, when the recording medium has moved in a different direction from the predetermined transport direction;

DETAILED DESCRIPTION

In the following, an exemplary embodiment of the present invention will be described, based on the drawings.

Figure 1:
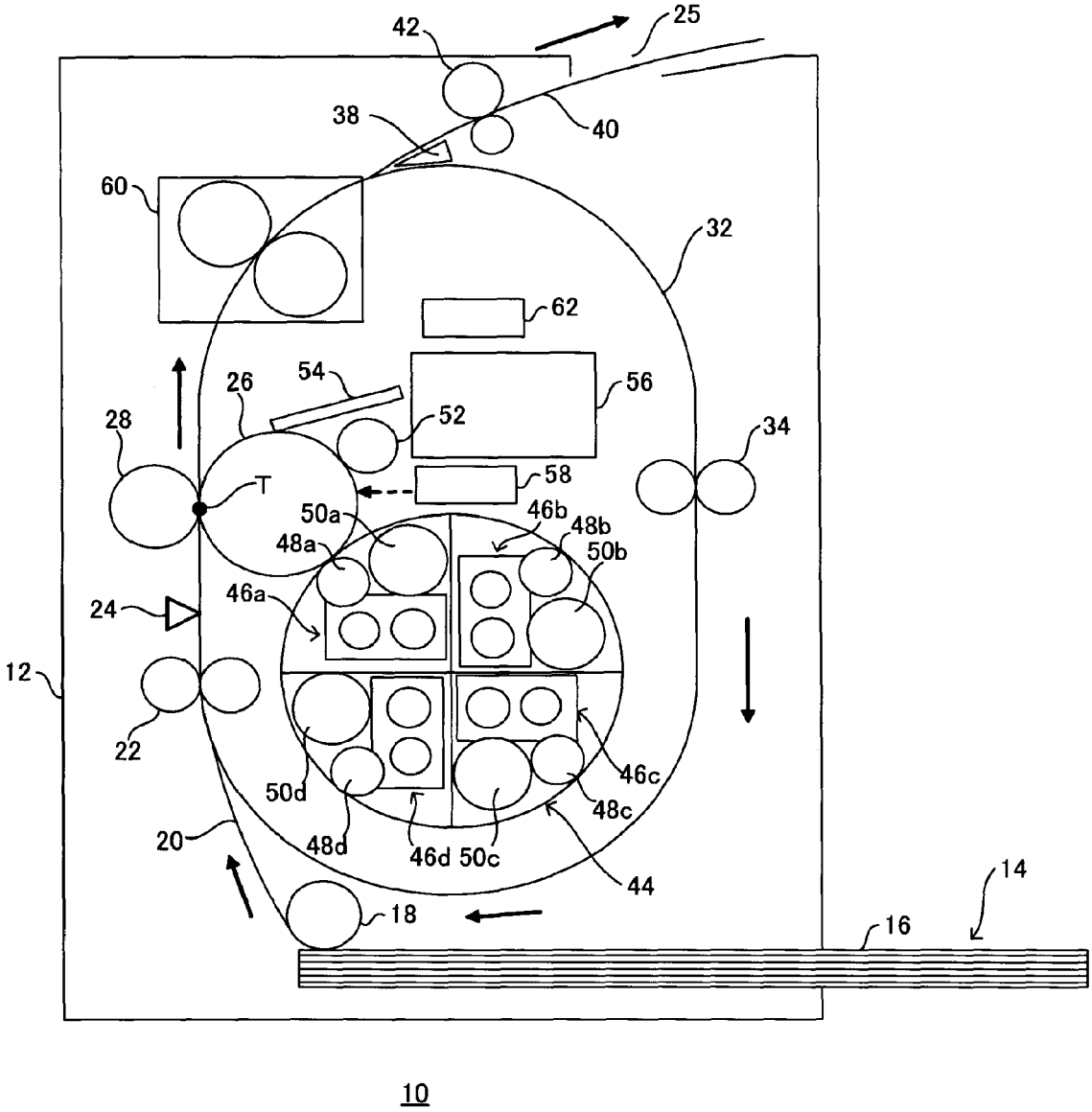
FIG. 1 is a side view depicting an overview of an image forming apparatus according to an exemplary embodiment of the invention.

FIG. 1 depicts an overview of an image forming apparatus 10 according to an exemplary embodiment of the invention. The image forming apparatus 10 has an image forming apparatus main body 12 and a paper feed unit 14 which may have, for example, a single cassette disposed in the bottom of the image forming apparatus main body 12.

The paper feed unit 14 includes a paper cassette 16 in which recording media such as paper are contained. The paper cassette 16 is adapted to be capable of feeding plural different forms of recoding media. At the top of the paper cassette 16, a pickup roller 18 is disposed to pick up a recording medium from the paper cassette 16.

The pickup roller 18 is driven by a driving mechanism which is not shown and rotates to feed a recording medium toward a first transport path 20. The first transport path 20 is the passage of a recoding medium from the pickup roller 18 to skew rollers 22.

Figure 2A:
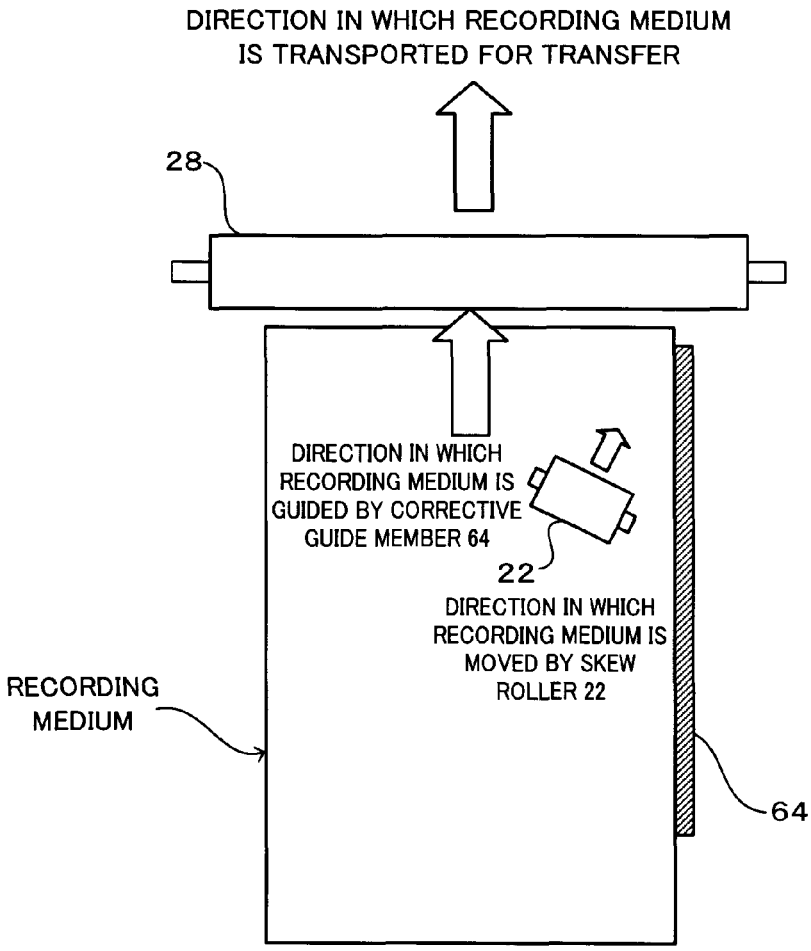

The skew rollers 22 are made of a material such as urethane with hardness, e.g., not more than 40 degrees, where the diameter of the roller is, e.g., 12 to 30 mm. The skew rollers 22, as is illustrated in FIG. 2A, transport a recording medium toward a transfer position T (FIG. 1) while exerting a force on the recording medium in a direction causing a side edge of the medium along its transport direction to abut a corrective guide member 64, so that it will correct the placement of the recording medium with the corrective guide member 64 (this will be detailed later using FIG. 3 and others). For instance, if a recording medium slanting against the transport direction arrives at the skew rollers 22, the skew rollers 22 move the recording medium nipped therebetween toward the corrective guide member 64, which causes the rear edge of the recording medium in the transport direction to first contact the corrective guide member 64. As the skew rollers 22 further move the recording medium toward the corrective guide member 64, the recording medium is guided by the corrective guide member 64 and moves along the corrective guide member 64. That is, the side edge of the recording medium is aligned to a predetermined position and the recording medium is transported in a predetermined transport direction (guiding direction) along the corrective guide member 64. The corrective guide member 64 and a transfer roller 28, which will be described later, contact the recording medium simultaneously for a period of time.

The first transport path 20 (FIG. 1) together with a part of a second transport path 32 and a third transport path 40 provides the passage of a recording medium up to an ejection port 25. Along the passage of a recording medium, upstream of a fixing device 60, an image carrier 26 and the transfer roller 28 having, e.g., an elastic surface are arranged. Upstream of the image carrier 26 and the transfer roller 28, the above-mentioned skew rollers 22 are disposed. A contact portion between the image carrier 26 and the transfer roller 28 corresponds to a transfer position T (a nip portion with a band-like region) where a developer image present on the image carrier 26 is transferred to a recording medium.

The image carrier 26 and the transfer roller 28 transport a recording medium nipped therebetween and the speed of their rotation is set to transport a recording medium at a speed faster than the speed at which the skew rollers 22 transport the recording medium (there is a predetermined ratio between both speeds).

Downstream of the skew rollers 22, a sensor (exposure timing sensor) 24 is disposed for controlling the timing at which an exposure device (projection aligner) 58 to be described later projects an electrostatic latent image on the image carrier 26. The sensor 24 is an optical sensor that detects the forward edge of a recording medium in the transport direction (passage of a recording medium) and outputs the result of the detection to a controller 62.

The second transport path 32 is a loop path for transporting a recording medium so that the recording medium circulates from the skew rollers 22 via the transfer position T and the fixing device 60 to the skew rollers 22 again. In the second transport path 32, for example, transport rollers 34 are provided to transport a recoding medium leaving the fixing device 60 toward the skew rollers 22. The transport rollers 34 nip a recording medium having a developer image fixed thereon by the fixing device 60 therebetween and transport it toward the skew rollers 22.

Along the second transport path 32, a switching device 38 is provided downstream of the fixing device 60. The third transport path 40 is formed that diverges from the second transport path 32 by the switching device 38 and extends to the ejection port 25. Along the third transport path 40, eject rollers 42 are disposed in proximity to the ejection port 25.

Accordingly, a recording medium picked up by the pickup roller 18 from the paper cassette 16 in the paper feed unit 14 is guided to the first transport path 20 and its placement is corrected by the skew rollers 2 and corrective guide member 64. Then, the recording medium passes between the image carrier 26 and the transfer roller 28 and, thereby transferring, e.g., a black developer image to the medium. This transferred black developer image is fixed by the fixing device 60. The recording medium is eventually ejected from the ejection port 25 by the eject rollers 42.

In the case of color printing, however, the recording medium is switched by the switching device 38 to pass through the second transport path 32 and circulate, so that the medium passes the skew rollers 22 four times in all. More specifically, the recording medium passes the skew rollers 22, the transfer position T, and the fixing device 60 four times in all, before it is ejected from the ejection port 25.

In the image forming apparatus main body 12, a rotary development device 44 is disposed, for example, in a lower section approximately in the middle of the main body. The rotary development device 44 includes development units 46*a* to 46*d* respectively containing four colors of developers, i.e., yellow, magenta, cyan, and black developers. The development units 46*a* to 46*d*, respectively, include development rollers 48*a* to 48*d* and developer containers 50*a* to 50*d* which are removable. The development units 46*a* to 46*d*, respectively, supply the developers contained in the developer containers 50*a* to 50*d* to the development rollers 48*a* to 48*d* and make an electrostatic latent image present on the image carrier 26 visible with each color developer in turn.

In front of the image carrier 26, a charging device 52, which is formed of, for example, a charging roller, is provided to evenly charge the image carrier 26. Furthermore, an image carrier cleaner 54 contacts the image carrier 26, upstream relative to the charging device 52 in the direction of rotation of the image carrier 26. The image carrier cleaner 54 scrapes away developer particles remaining on the image carrier 26 after transfer. In front of the image carrier cleaner 54, a developer collector 56 that collects developer particles scraped away by the image carrier cleaner 54 is removably installed.

Between the rotary development device 44 and the developer collector 56, the exposure device 58 is disposed that projects an electrostatic latent image on the image carrier 26 charged by the charging device 52, using a beam such as a laser beam. At the rear side of the image carrier 26, the above-mentioned transfer roller 28 is located. The transfer roller 28 is made of a material such as urethane foam with hardness, e.g., not more than 40 degrees, where the diameter of the roller is, e.g., 12 to 20 mm. The transfer roller 28 and the image carrier 26 transport a recording medium nipped therebetween at the transfer position T. Thereby, the transfer roller 28 overlayingly transfers each developer image developed by the developer 46*a* to 46*d* sequentially from the image carrier 26 to a recording medium in the transfer position T.

Figure 2B:
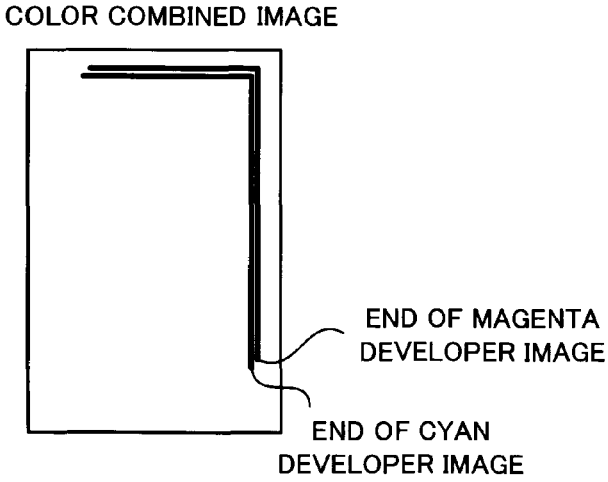

For example, for a recording medium to which a developer image in a first color has been transferred from the image carrier 26, when the transfer roller 28 is about to transfer a developer image in a second color, the skew rollers 22 transport the recording medium toward the transfer position T while exerting a force on the recording medium in a direction causing the side edge of the recording medium along its transport direction to abut the corrective guide member 64. Thereby, the developer images in different colors (including, e.g., their ends) are overlayingly transferred in substantially the same position, as is illustrated in FIG. 2B.

The fixing device 60 is disposed downstream of the transfer position T. The fixing device 60 includes a heating roller and a pressure roller, transports a recording medium having a developer image transferred thereto by the image carrier 26 and transfer roller 28 while nipping it in a contact portion (nip portion: fixing position) between the heating roller and the pressure roller, and fixes the developer image onto the recording medium by applying heat and pressure to the developer image.

In the image forming apparatus main body 12, the controller 62 that controls the components of the image forming apparatus 10 is disposed.

Then, a relationship between a force exerted on a recording medium by the skew rollers 22 and a force exerted on the recording medium by the transfer roller 28 is described in detail.

Figure 3:
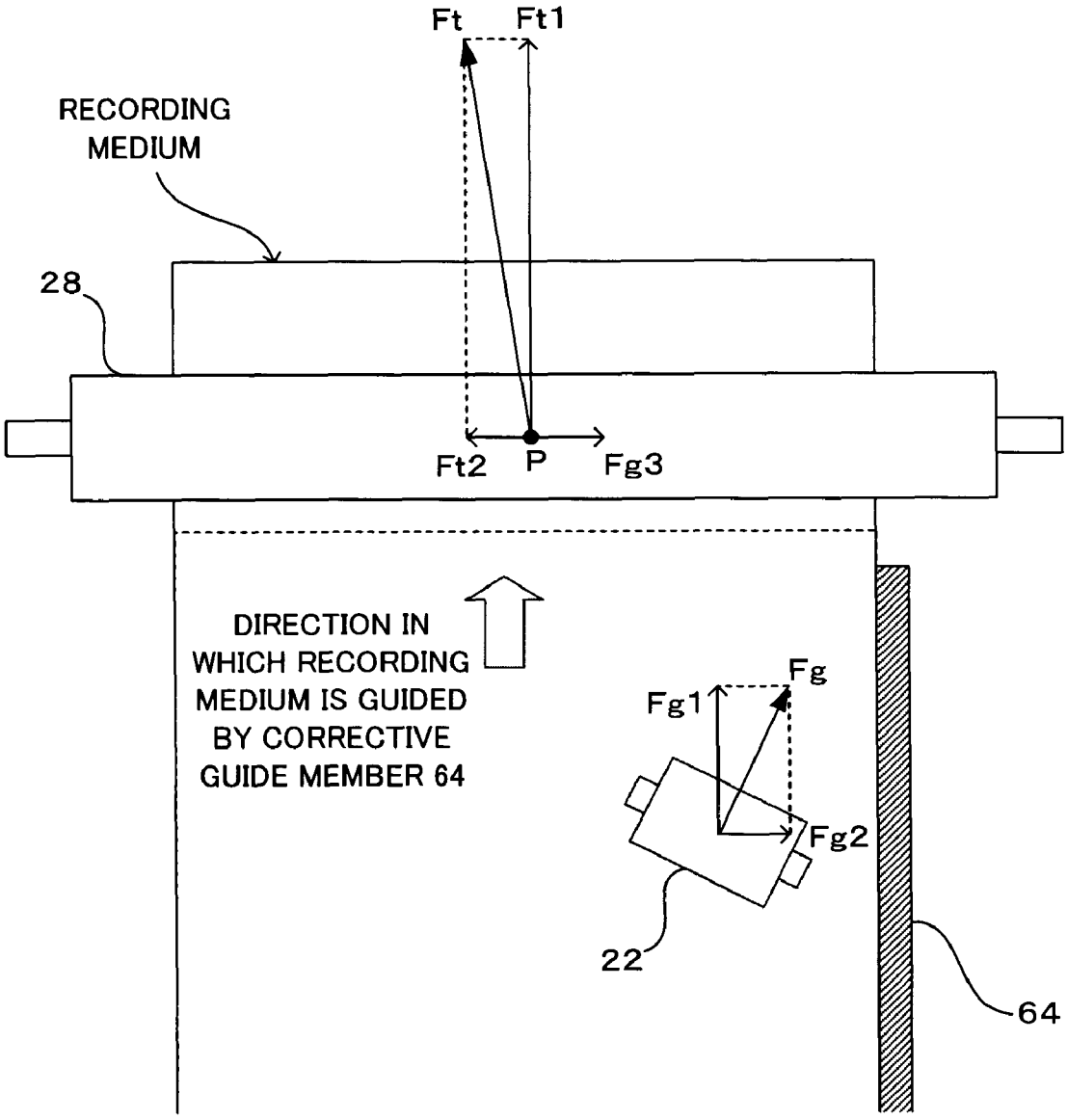
FIG. 3 schematically illustrates a relationship between a force exerted on a recording medium by the skew rollers and a force exerted on the recording medium by the transfer roller (and the image carrier)

FIG. 3 schematically illustrates the relationship between a force exerted on a recording medium by the skew rollers 22 and a force exerted on the recording medium by the transfer roller 28 (and the image carrier 26).

As is shown in FIG. 3, the skew rollers 22 transport a recoding medium by a moving force Fg. Thereby, the skew rollers 22 transport the recording medium toward the transfer position T while exerting the force in a direction causing the side edge of the recording medium along its transport direction to abut the corrective guide member 64. Specifically, the skew rollers 22 exert a force component Fg1 in a direction (guiding direction) in which the corrective guide member 64 guides the recording medium and a force component Fg2 in a direction orthogonal to the guiding direction. The skew rollers 22 exert the force on the entire recording medium and they also exert a force Fg3 in relation to the magnitude of the force component F2 on, e.g., a point P on the recording medium located within the transfer position T which is a band-like region.

On the other hand, the transfer roller 28 and the image carrier 26 nip the recording medium therebetween and transport the recording medium by a moving force Ft. However, the direction of the moving force Ft of the transfer roller 28 may skew toward a direction in which there is not the corrective guide member 64 (in the direction opposite to the corrective guide member 64) (see FIG. 6). As is shown in FIG. 3, in a case where the moving force Ft skews toward the direction opposite to the corrective guide member 64 with respect to the direction (guiding direction) in which the corrective guide member 64 guides the recording medium, the transfer roller 28 and the image carrier 26 exert a force component Ft1 in the guiding direction and a force component Ft2 in the direction orthogonal to the guiding direction. That is, the transfer roller 28 and the image carrier 26 exert the force on the entire recording medium and they also exert the force component Ft2 on, e.g., the point P on the recording medium located within the transfer position T which is a band-like region.

Figure 4:
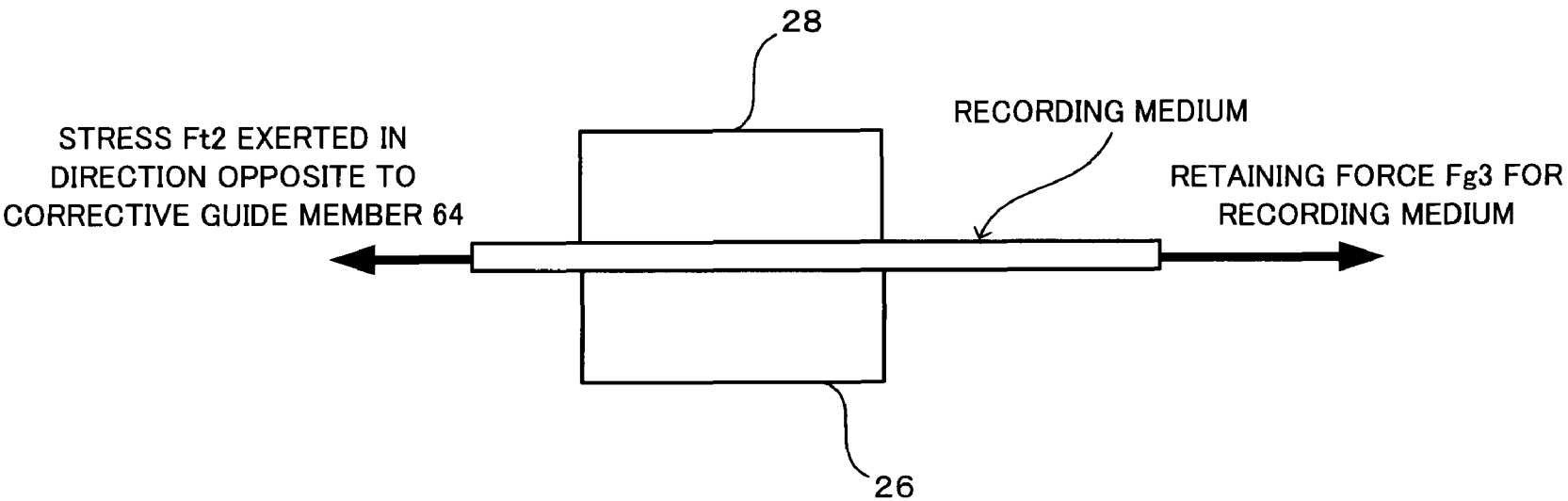
FIG. 4 schematically illustrates a relationship between a force Fg3 exerted on a point P by the skew rollers and a force component Ft2 exerted on the recording medium by the transfer roller (and the image carrier)

Here, the direction of the force Fg3 exerted on the point P by the skew rollers 22 is opposite to the direction of the force component Ft2 exerted on the point P by the transfer roller 28. The moving force Fg of the skew rollers 22 is set so that the force Fg3 will be larger than the force component Ft2. Specifically, the force Fg3 is the force that is related to the magnitude of the force component Fg2 of the skew rollers 22 and that is conveyed to a point on the recording medium located in the transfer position T. As is indicated in FIG. 4 as well, the force Fg3 is larger than the force component Ft2 (stress exerted in the direction opposite to the corrective guide member 64) and acts as a retaining force for the recording medium to keep the side edge of the recording medium abutting the corrective guide member 64.

Figure 5:
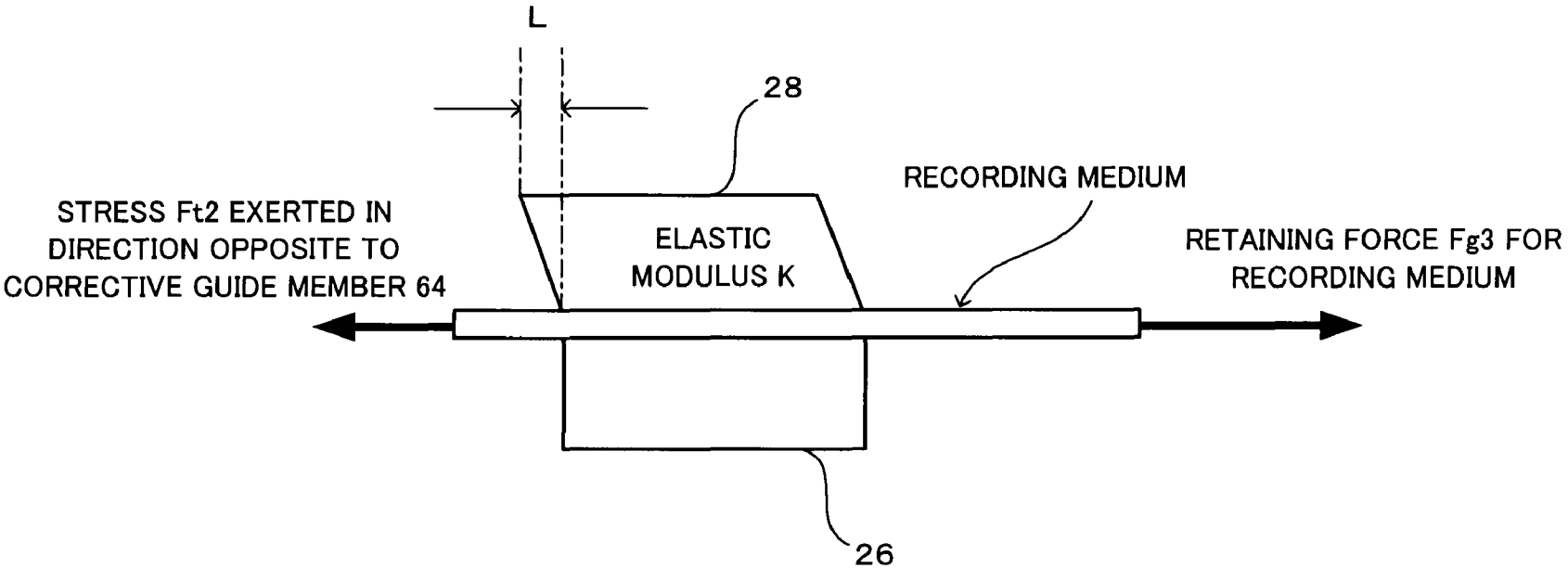
FIG. 5 schematically illustrates another form of the relationship between the force Fg3 exerted on the point P by the skew rollers and the force component Ft2 exerted on the recording medium by the transfer roller (and the image carrier)

The transfer roller 28 is an elastic body, as noted above. As is indicated in FIG. 5, its elastic modulus K may be set so that the product (=Ft2) of the elastic modulus (coefficient of elasticity) K and the amount of deformation L of the transfer roller 28 will be smaller than the force Fg3 (the retaining force for a recording medium).

Figure 6A:
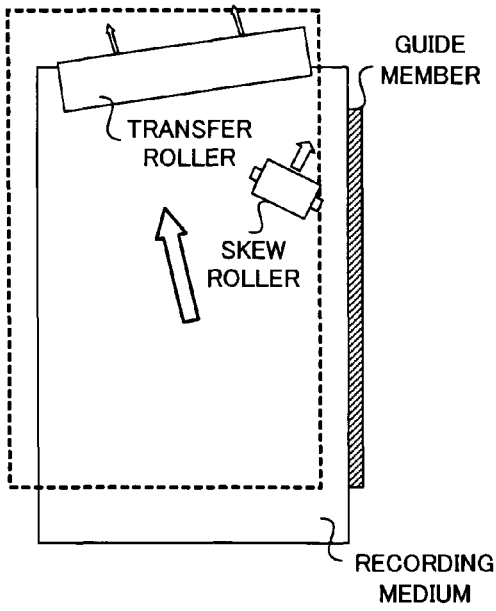
Figure 6B:
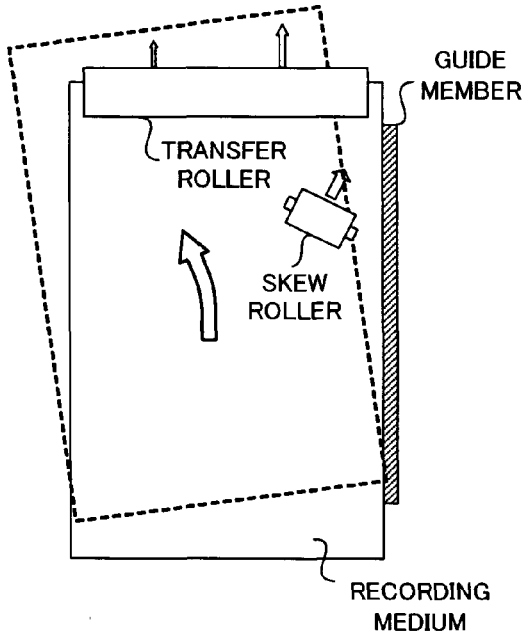
Figure 6C:
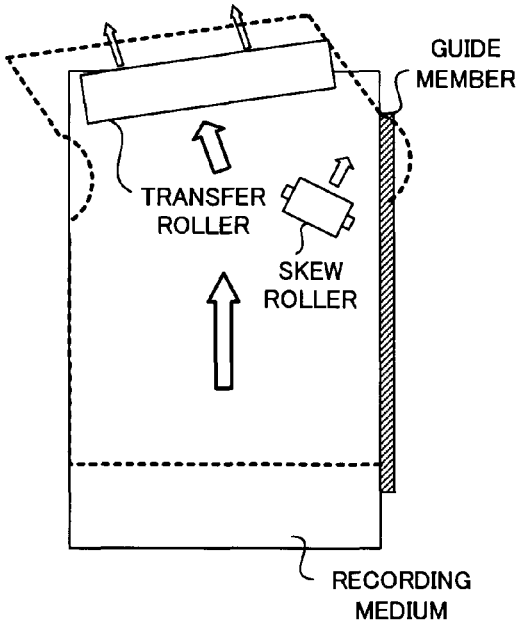
Figure 6D:
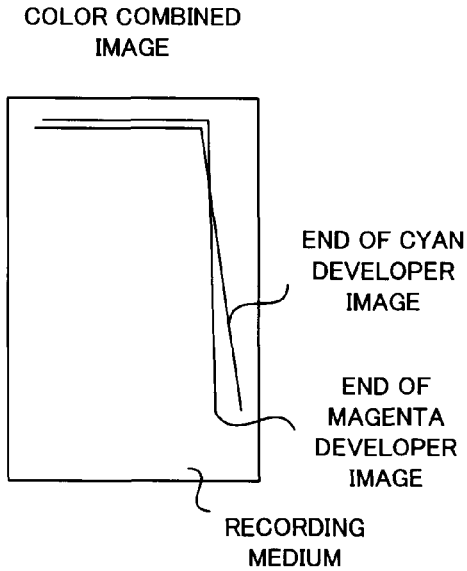

FIGS. 6A to 6D schematically illustrate a comparison example as compared to the present invention, wherein FIGS. 6A to 6C illustrate how a recording medium is directed, when transported by the transfer roller 28 and the image carrier 26 with the aid of the skew rollers 22 and FIG. 6D illustrates a combined image resulting from developer images in different colors, when the recording medium has moved in a different direction from the predetermined transport direction.

As is shown in FIG. 6A, even if the skew rollers exert the moving force on a recording medium toward the guide member that guides the recording medium in a predetermined direction, when the transfer roller exerts the moving force that is stronger than the moving force of the guide members on the recording medium in a direction moving the recording medium away from the corrective guide member, the recording medium moves in a different direction from the direction in which the guide member guides it.

Likewise, as is shown in FIG. 6B, even if the skew rollers exert the moving force on a recording medium toward the guide member that guides the recording medium in a predetermined direction, due to different contact pressures (nip pressures) in both ends of the transfer roller, the recording medium moves in a different direction from the direction in which the guide member guides it.

Likewise, as is shown in FIG. 6C, even if the skew rollers exert the moving force on a recording medium toward the guide member that guides the recording medium in a predetermined direction, when the recording medium sags between the transfer roller and the skew rollers, the moving force of the skew rollers is not sufficiently conveyed to the recording medium located in the transfer position, with the result that the recording medium moves in a different direction from the direction in which the guide member guides it.

If the recording medium moves in a different direction from the direction in which the guide member guides it, then the developer images mismatch in position, shape, etc, as is illustrated in FIG. 6D.

Next, an overall operation (color printing) of the image forming apparatus 10 is described.

When a signal to make an image is delivered, the image carrier 26 is evenly charged by the charging device 52. Based on the image signal, a beam corresponding to a yellow image is emitted from the exposure device 58 toward the charged image carrier 26. The beam from the exposure device 58 irradiates the surface of the image carrier 26 and an electrostatic latent image is formed thereon.

The electrostatic latent image present on the image carrier 26 is developed with a yellow developer supplied to the development roller 48*a* in the development unit 46*a*. Then, the developed image is transferred onto a recording medium fed from the paper feed unit 14. The recording medium having the yellow developer image transferred thereto is guided to the fixing device 60 where the developer image is fixed by the heating roller and the pressure roller.

Then, the recording medium having the yellow developer image fixed thereon is guided toward the transport rollers 34 by the switching device 38. The transport rollers 34 transport the recording medium toward the skew rollers 22.

Developer particles remaining on the image carrier 26 are scraped away by the image carrier cleaner 54 and collected into the developer collector 56.

Again, the image carrier 26 is evenly charged by the charging device 52. Based on the image signal, a beam corresponding to a magenta image is emitted from the exposure device 58 toward the charged image carrier 26. The beam from the exposure device 58 irradiates the surface of the image carrier 26 and an electrostatic latent image is formed thereon.

The electrostatic latent image present on the image carrier 26 is developed with a magenta developer supplied to the development roller 48*b* in the development device 46*b*. Then, the developed image is overlayingly transferred onto the recording medium which has been transported by the transport rollers 34 while placed correctly by the skew rollers 22 and the corrective guide member 64 under control of the controller 62.

The recording medium having the magenta developer image transferred thereto is guided to the fixing device 60 where the developer image is fixed by the heating roller and the pressure roller. The recording medium having the magenta developer image fixed thereon is guided toward the transport rollers 34 by the switching device 38. Developer particles remaining on the image carrier 26 are scraped away by the image carrier cleaner 54 and collected into the developer collector 56.

The recording medium is returned toward the transport rollers 34 three times in all, during which, like the black and magenta developer images, when developer images developed with cyan and black developers are fixed onto the recording medium by the fixing device 60, a color image into which all the developer images are combined is formed on the recording medium. The recording medium having the color image fixed thereon is guided to the eject rollers 24 by the switching device 38 and ejected.

Next, modification examples of skew rollers 22 are described.

Figure 7A:
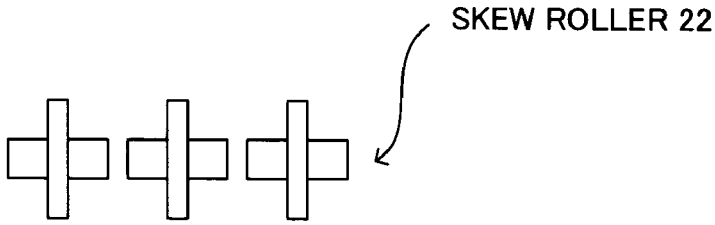
FIGS. 7A to 7C are front views showing modification examples of skew rollers 22, respectively.
Figure 7B:
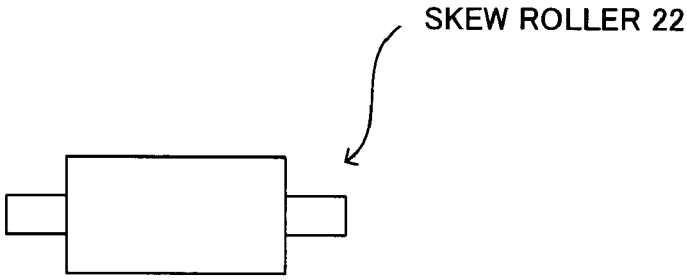
Figure 7C:
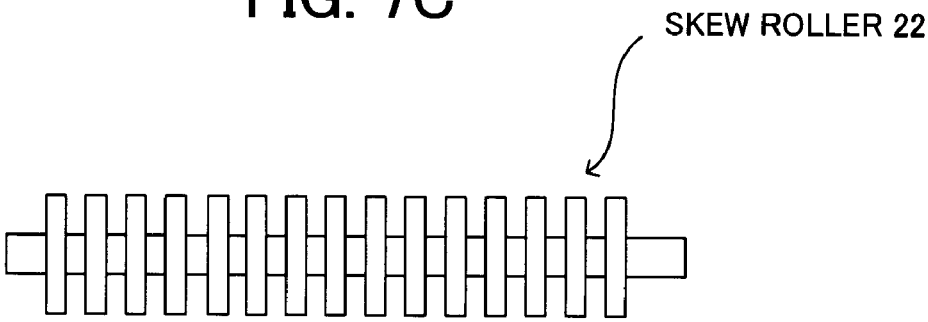

FIGS. 7A to 7C are front views showing modification examples of skew rollers 22, respectively. As is shown in FIG. 7A, a skew roller 22 may be made up of plural members having a narrow width brought in contact with a recording medium. Alternatively, as is shown in FIG. 7B, a skew roller 22 may be made as a monolithic rubber roller having a wide width brought in contact with a recording medium. Alternatively, as is shown in FIG. 7C, a skew roller 22 may be made as a monolithic roller with plural vertical disks with a thickness arranged on a horizontal shaft and evenly spaced apart from each other, wherein the thickness of each disk is a narrow width brought in contact with a recording medium.

The width of a skew roller 22 (axial length) may be selected within a range of, e.g., 2 to 250 mm.

In the following, methods for measuring the force component Ft2 and the force Fg3 (the retaining force for a recording medium) are discussed.

Figure 8:
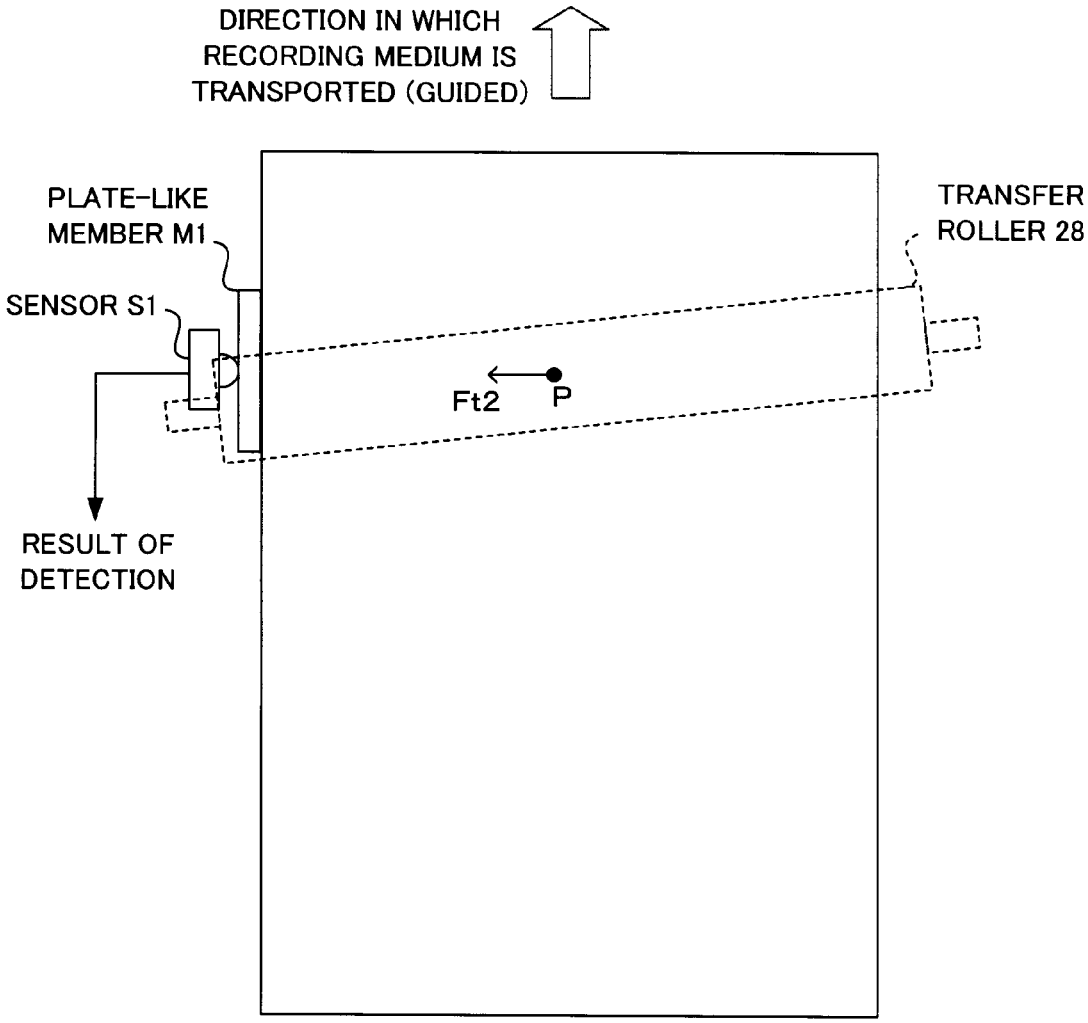
FIG. 8 illustrates a method for measuring a force component Ft2.

FIG. 8 illustrates a method for measuring the force component Ft2.

As is illustrated in FIG. 8, the force component Ft2 of the moving force Ft exerted on the point P included in the transfer position T by the transfer roller 28 and the image carrier 26 is measured via a plate-like member M1 and a sensor S1. The plate-like member M1 is installed so as to contact the other side edge of the recording medium in the transport direction (the side edge that is parallel with the guide direction and opposite to the corrective guide member 64) within a region (corresponding to the transfer position T) including the point P on the recording medium. The plate-like member M1 can be displaced by a force conveyed from the recording medium. The sensor S1 is a load converter that converts a load (force) into an electric signal and detects the force component Ft2 by detecting a pressing force exerted on the sensor S1 by the plate-like member M1.

Figure 9:
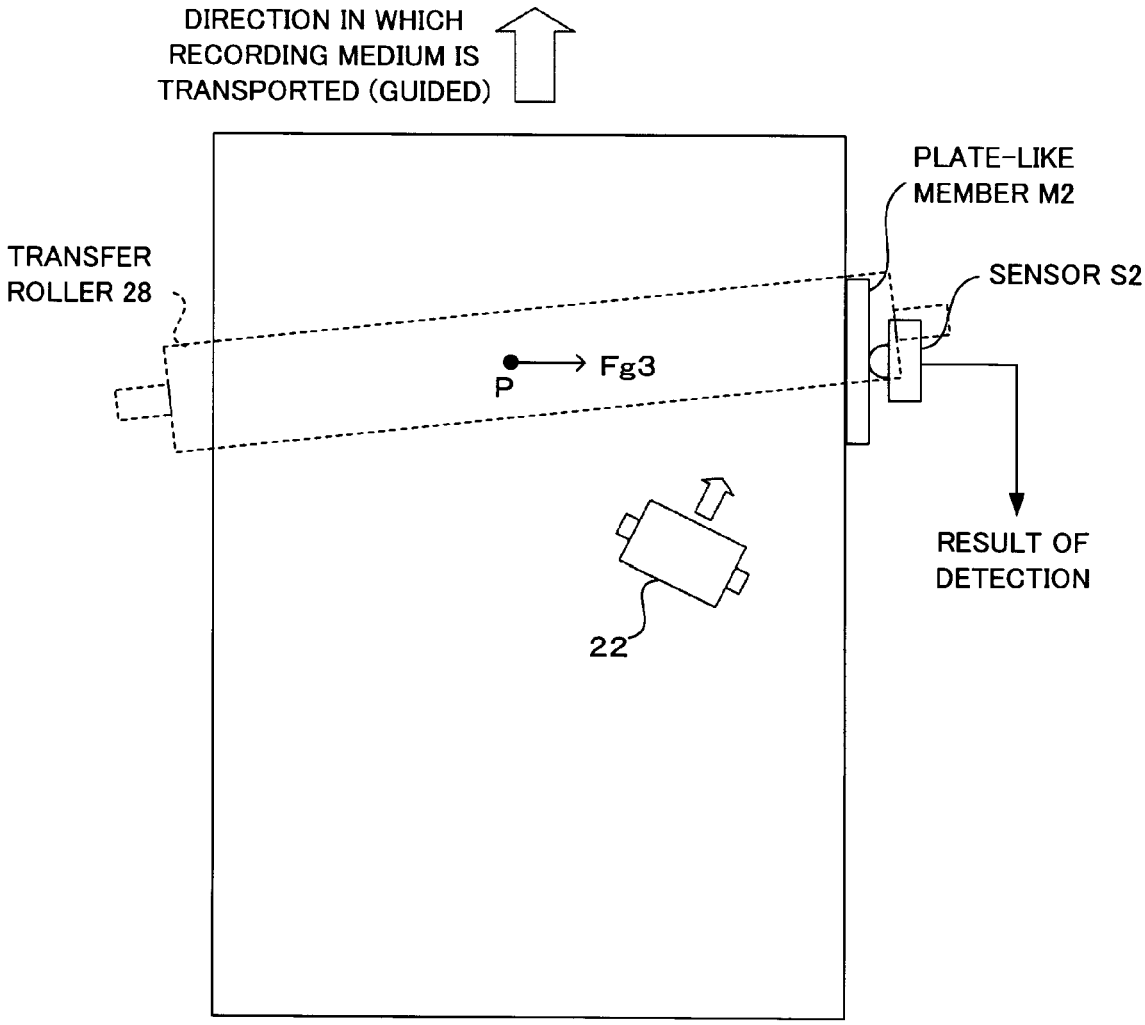
FIG. 9 illustrates a method for measuring a force Fg3.

FIG. 9 illustrates a method for measuring the force Fg3.

As is illustrated in FIG. 9, the force Fg3 exerted on the point P included in the transfer position T by the skew rollers 22 is measured via a plate-like member M2 and a sensor S2. During this measurement, the image carrier 26 and the transfer roller 28 are put in a noncontact state. The plate-like member M2 is installed so as to contact the side edge of the recording medium in the transport direction (the side edge that is parallel with the guide direction and is to contact the corrective guide member 64) within the region (corresponding to the transfer position T) including the point P on the recording medium. The plate-like member M2 can be displaced by a force conveyed from the recording medium. The sensor S2 is a load converter that converts a load (force) into an electric signal and detects the force Fg3 by detecting a pressing force exerted on the sensor S2 by the plate-like member M2.

The plate-like members M1, M2 and the sensors S1, S2 may be disposed within the image forming apparatus 10 or may be attachable to the image forming apparatus 10.

The exemplary embodiment of the invention has been described previously for an example where a recording medium is transported to circulate in the loop transport path and the developer images in plural colors are transferred in turn. However, the scope of the invention is not so limited. For instance, the image forming apparatus 10 may be a so-called tandem type of image forming apparatus in which a recording medium is transported by a conveyor belt and the developer images in plural colors are transferred in turn or may be an image forming apparatus in which only a developer image in a single color is transferred.

The present invention may be embodied in other specific forms without departing from its spirit or characteristics. The described exemplary embodiment is to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed is:

1. An image forming apparatus comprising:

an image carrier;

a development unit that develops an electrostatic latent image present on the image carrier with a developer;

a transfer member that transfers a developer image developed by the development unit from the image carrier to a recording medium by transporting while nipping the recording medium in a transfer position in contact with the image carrier;

a corrective guide member that contacts the recording medium which is simultaneously caught by the transfer member for a period and that corrects placement of the recording medium with respect to the transfer member, thus guiding the recording medium toward the transfer position; and a transport unit that transports the recording medium toward the transfer position while exerting a force on the recording medium in a direction causing a side edge of the recording medium along a transport direction to abut the corrective guide member, so that a force exerted on the recording medium in the transfer position in a direction orthogonal to a guide direction in which the corrective guide member guides the recording medium is larger than a force component in a direction orthogonal to the guide direction of a force by which the image carrier and the transfer member transport the recording medium in the transfer position;

wherein a speed at which the transport unit transports a recording medium is set slower than a transport speed at which the image carrier and the transfer member transport a recording medium.

2. The image forming apparatus according to claim 1, wherein the transfer member is elastically deformed in the direction orthogonal to the guide direction when transporting while nipping a recording medium in contact with the image carrier.

3. The image forming apparatus according to claim 1, wherein the speed at which the transport unit transports a recording medium is set at a predetermined ratio to the transport speed at which the image carrier and the transfer member transport a recording medium.

4. The image forming apparatus according to claim 1, including a transport path;

wherein the transfer member is a transfer roller, the transport path is a loop path for transporting the recording medium so that the recording medium circulates to and from the transfer roller, and the transfer roller overlayingly transfers multiple developer images to one said recording medium.

5. The image forming apparatus according to claim 1, including a first sensor for detecting a force component exerted on the recording medium by the transfer member in the direction orthogonal to the guide direction in which the corrective guide member guides the recording medium, and a second sensor for detecting a force component exerted on the recording medium by the transport unit in a direction that is opposite the force component exerted by the transfer member.

* * * * *